US006745622B2

(12) United States Patent
Smith et al.

(10) Patent No.: US 6,745,622 B2
(45) Date of Patent: Jun. 8, 2004

(54) APPARATUS AND METHOD FOR INSPECTING DOVETAIL SLOT WIDTH FOR GAS TURBINE ENGINE DISK

(75) Inventors: Douglas Raymond Smith, Hamilton, OH (US); Stefan Andreas Moser, West Chester, OH (US); Daniel Edward Jones, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 51 days.

(21) Appl. No.: 10/285,230

(22) Filed: Oct. 31, 2002

(65) Prior Publication Data

US 2004/0083801 A1 May 6, 2004

(51) Int. Cl.[7] ..... G01M 15/00
(52) U.S. Cl. ..... 73/117.4
(58) Field of Search ..... 73/116, 117.2, 73/117.3, 117.4, 118.1, 119 R, 865.9

(56) References Cited

U.S. PATENT DOCUMENTS 5,065,635 A * 11/1991 Burtner et al. ..... 73/866.5
5,315,234 A * 5/1994 Sutton et al. ..... 324/242
5,345,514 A 9/1994 Mahdavieh et al. ..... 382/8
5,442,286 A 8/1995 Sutton, Jr. et al. ..... 324/242
6,250,166 B1 * 6/2001 Dingwell et al. ..... 73/810
6,339,326 B1 * 1/2002 Trantow ..... 324/219
6,469,503 B2 * 10/2002 Trantow et al. ..... 324/219
6,545,467 B1 * 4/2003 Batzinger et al. ..... 324/219
6,563,307 B2 * 5/2003 Trantow et al. ..... 324/219
6,608,478 B1 * 8/2003 Dziech et al. ..... 324/262
2002/0135363 A1 * 9/2002 Trantow et al. ..... 324/219
2003/0025496 A1 * 2/2003 Trantow et al. ..... 324/219
2003/0044284 A1 * 3/2003 Leeke et al. ..... 416/219 R
2003/0129060 A1 * 7/2003 Knott et al. ..... 416/219 R
2003/0221497 A1 * 12/2003 Murphy et al. ..... 73/865.9

* cited by examiner

*Primary Examiner*—Eric S. McCall
(74) *Attorney, Agent, or Firm*—V. G. Ramaswamy; James P. Davidson

(57) ABSTRACT

An apparatus and method for inspecting a dovetail slot of a gas turbine engine disk, including: a first pin member fixed in a stationary position; a second pin member having the ability to move between a first position and a second position, wherein the second pin member is oriented substantially parallel to the first pin member; a member actuable between a first position and a second position, wherein the member functions to automatically position the first and second pin members in a predetermined position within the dovetail slot when in the second member position; a first probe for measuring a distance between the first and second pin members when in the predetermined dovetail slot position; and, at least one plate member forming a base to which the first pin member, the second pin member, the actuable member, and the first probe are assembled in a predetermined manner.

26 Claims, 10 Drawing Sheets

APPARATUS AND METHOD FOR INSPECTING DOVETAIL SLOT WIDTH FOR GAS TURBINE ENGINE DISK

BACKGROUND OF THE INVENTION

The present invention relates generally to dovetail slots formed in disks of a gas turbine engine and, in particular, to an apparatus and method for inspecting such dovetail slots to ensure the proper width between adjacent parallel slot portions thereof.

It will be understood that gas turbine engines include compressors and turbines which include a plurality of circumferentially spaced blades connected to and extending from a disk. Typically, the blades are held in the disk by machining multiple slots around the perimeter of the disk and sliding the blade, which has a similarly shaped feature at its base, into the slot. The machined slots are oftentimes called dovetail slots because of their shape and must be held to close tolerances. One particular parameter which must be measured is the slot width, defined herein as the distance between a pair of pin members seated within adjacent parallel slot portions of the dovetail slot.

The dovetail slot width parameter is important because the respective bearing surfaces of the slot portions are crucial in maintaining the blade within the dovetail slot and incur the greatest amount of stress. It will be appreciated that the dovetail slot is generally formed by means of a broaching process, wherein the dovetail slot is progressively formed to a desired shape and dimension by a corresponding device. When the broaching device exhibits wear, the dovetail slot will not be formed in an exact manner. Accordingly, inspecting and monitoring the slot width of the dovetail slot enables broach wear to be recognized so that the device can be repaired or replaced.

Currently, a pair of precision gage pins are manually positioned in the slot portions and the distance between inner tangent points of such pins are measured. This requires a technician to hold the gage pins in one hand while simultaneously forcing a gage block between them using the other hand. If the gage block chosen is not the correct size, the technician must choose another gage block from the set and attempt to fit it between the gage pins. This process iterates until the best fitting gage block is found. Once the best gage block is obtained, the technician must hold the gage pins, as well as the gage block, in one hand and slide shims between the gage block and one of the gage pins until a precise fit is obtained between the gage pins. The thickness of the gage block and the shims is then added together to determine the slot width. This process generally takes approximately one-two minutes for each dovetail slot. Since a disk may have over 100 slots formed in its periphery, the time required to measure the slot width for all such dovetail slots therein could take several hours.

Accordingly, it would be desirable for an apparatus and method to be developed which inspects dovetail slot width in a quicker and more reliable manner. It is also desirable for such apparatus to be user friendly and able to be integrated in a system to monitor and control the manufacturing of such dovetail slots.

BRIEF SUMMARY OF THE INVENTION

In a first exemplary embodiment of the invention, an apparatus for inspecting a dovetail slot of a gas turbine engine disk is disclosed as including: a first pin member fixed in a stationary position; a second pin member having the ability to move between a first position and a second position, wherein the second pin member is oriented substantially parallel to the first pin member; a member actuable between a first position and a second position, wherein the member functions to automatically position the first and second pin members in a predetermined position within the dovetail slot when in the second member position; a first probe for measuring a distance between the first and second pin members when in the predetermined dovetail slot position; and, at least one plate member forming a base to which the first pin member, the second pin member, the actuable member, and the first probe are assembled in a predetermined manner.

In a second exemplary embodiment of the invention, a method of inspecting a dovetail slot for a gas turbine engine disk is disclosed as including the following steps: positioning a stationary pin member and a movable pin member within the dovetail slot; actuating a member from a first position to a second position so as to interface with the movable pin member until the stationary and movable pin members are automatically seated in a pair of substantially parallel slots within said dovetail slot; and, measuring a distance between the fixed and movable pin members when in the seated position.

In accordance with a third embodiment of the invention, an apparatus for inspecting a dovetail of a gas turbine engine blade is disclosed as including: a first pin member fixed in a stationary position; a second pin member having the ability to move between a first position and a second position, wherein the second pin member is oriented substantially parallel to the first pin member; a member actuable between a first position and a second position, wherein the member functions to automatically position the first and second pin members in a predetermined position on opposing sides of the dovetail during the second member position; a first probe for measuring a distance between the first and second pin members when in the predetermined position; and, at least one plate member forming a base to which the first pin member, the second pin member, the actuable member, and the first probe are assembled in a predetermined manner.

DETAILED DESCRIPTION OF THE INVENTION

Figure 1:
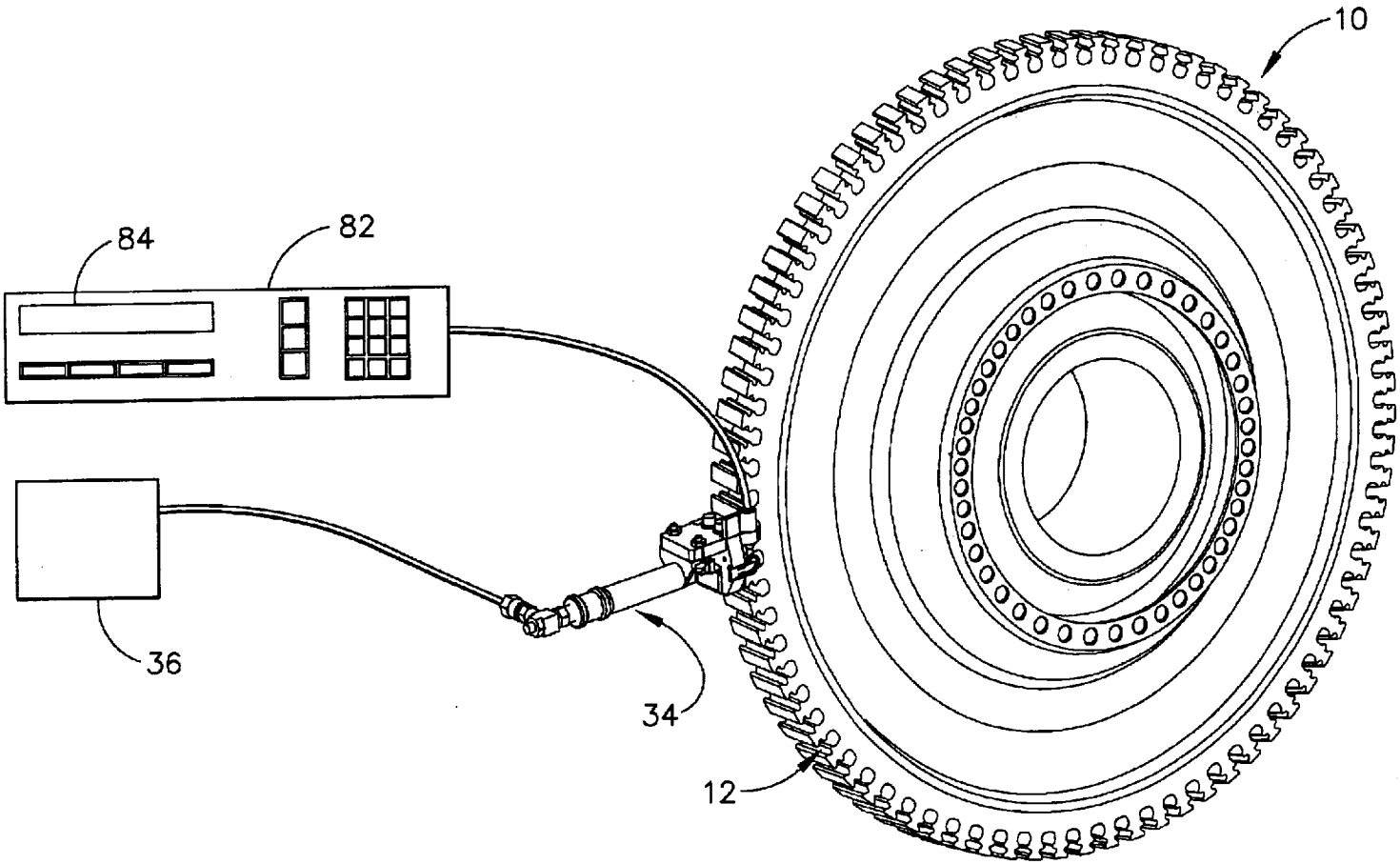
FIG. 1 is a perspective view of a disk for a gas turbine engine having an apparatus in accordance with the present invention retained within a dovetail slot thereof.

Referring now to the drawings in detail, wherein identical numerals indicate the same elements throughout the figures, FIG. 1 depicts an exemplary gas turbine engine disk identified generally by reference numeral 10. It will be understood that disk 10 is utilized for a turbine portion of a gas turbine engine, but may be any disk (e.g., for a gas turbine engine compressor) which has incorporated therein one or more dovetail slots 12. A gage or device, identified generally by reference numeral 34, is shown as being positioned within a dovetail slot and is utilized to measure a slot width of dovetail slot 12.

Figure 2:
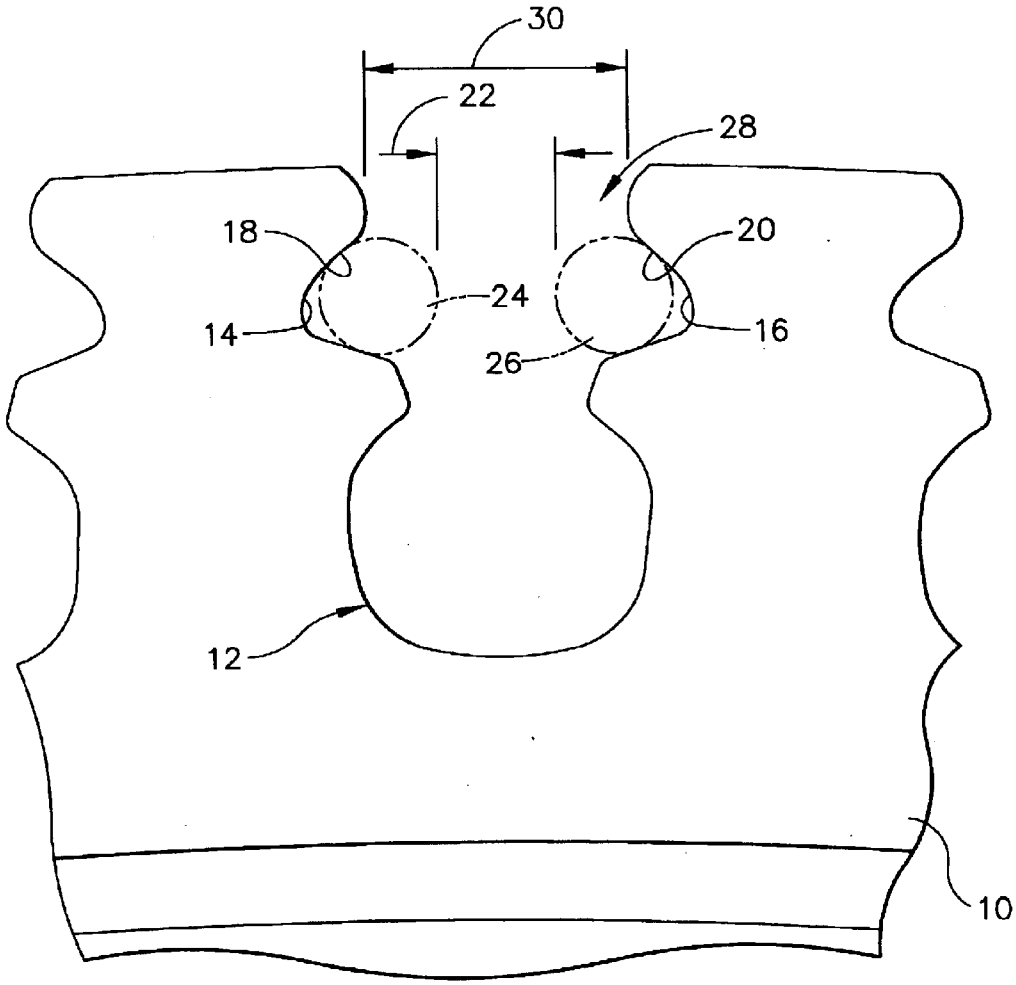
FIG. 2 is an enlarged side view of a dovetail slot like that formed in the disk depicted in FIG. 1.

As best seen in FIG. 2, each dovetail slot 12 includes a pair of substantially parallel slot portions 14 an 16 formed therein. The accuracy in the dimensions of dovetail slot 12 is important, particularly along bearing surfaces 18 and 20 of slot portions 14 and 16, respectively. It will be seen that a slot width 22 of dovetail slot 12 is defined as the distance between a tangent of a pair of gage pins (shown in phantom and identified by reference numerals 24 and 26). Dovetail slot 12 also includes an entrance 28 having a width 30 through which apparatus 34 is inserted.

Figure 3:
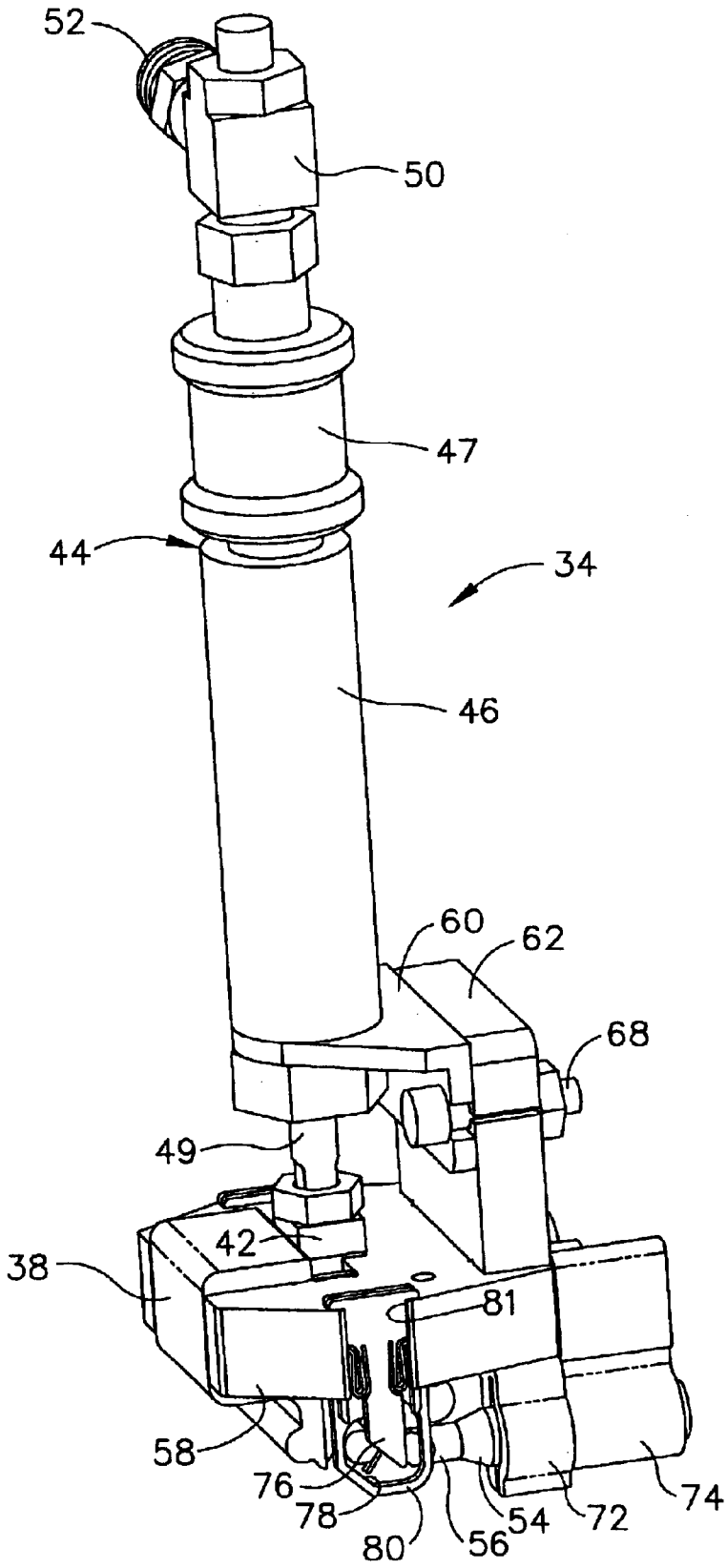
FIG. 3 is a perspective view of the apparatus depicted in FIG. 1, where such apparatus is able to measure the distance between opposing slot portions of the dovetail slot depicted in FIG. 2.
Figure 4:
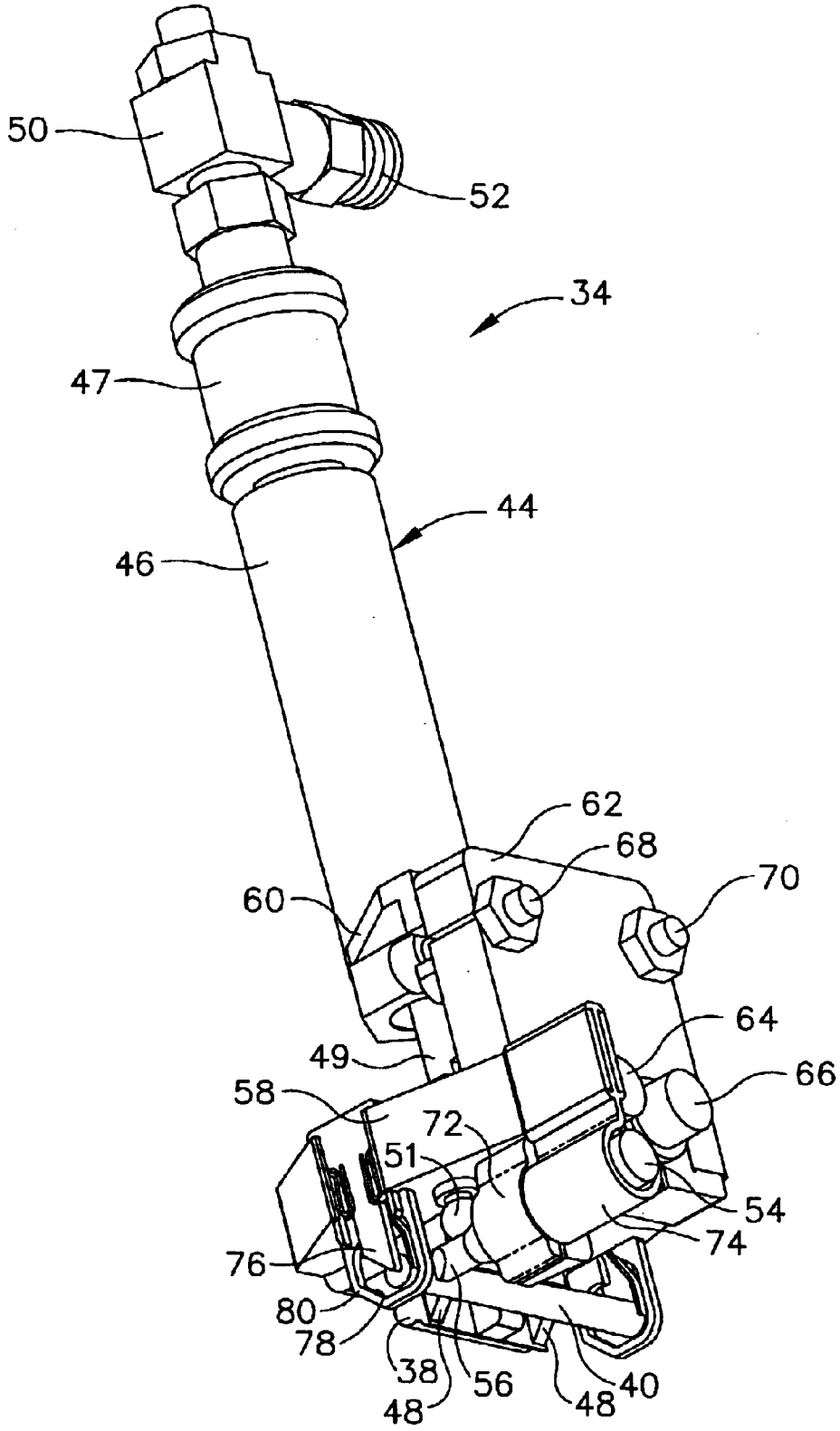
FIG. 4 is a bottom perspective view of the apparatus depicted in FIG. 3.
Figure 5:
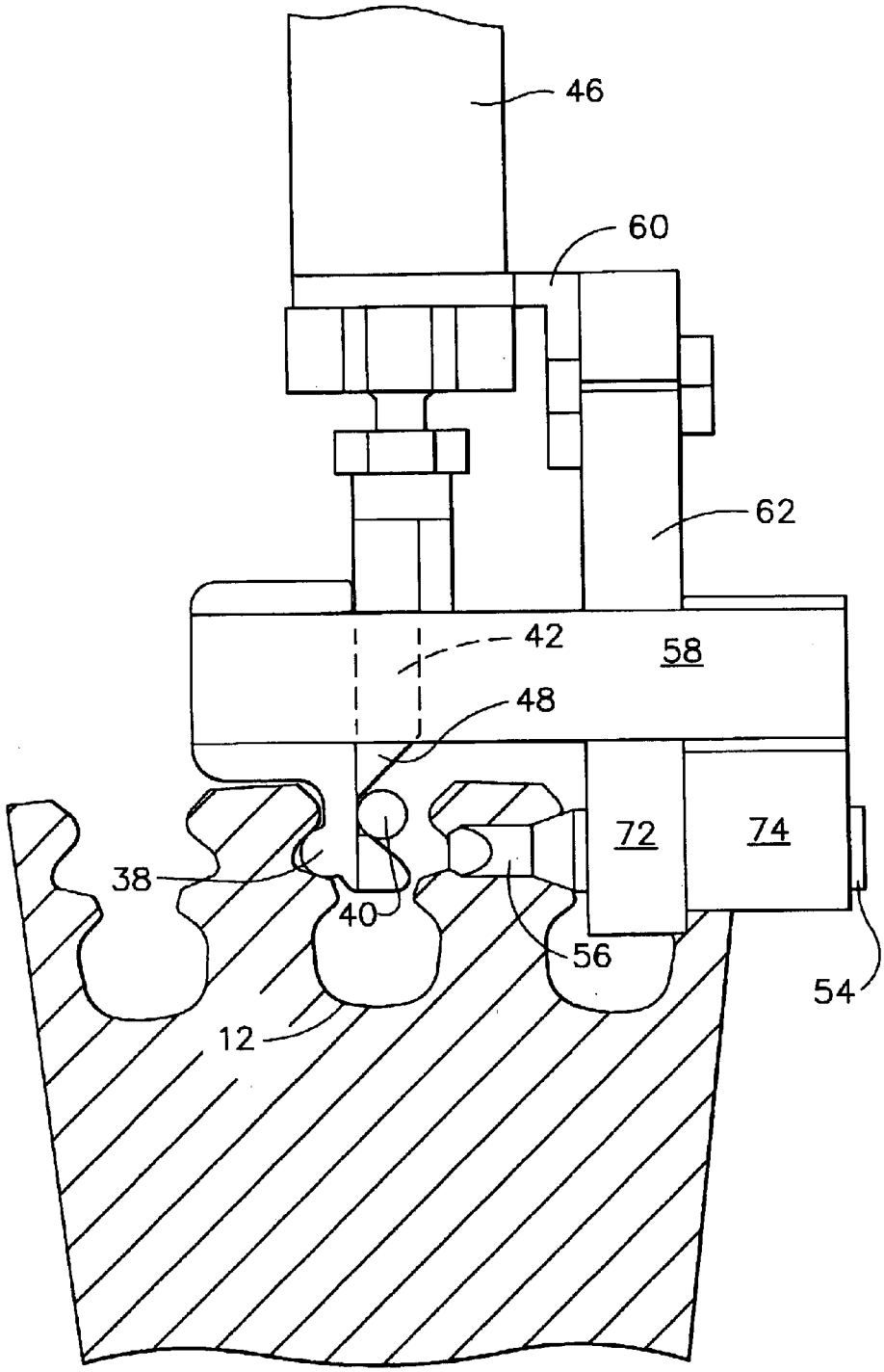
FIG. 5 is a partial side view of the apparatus depicted in FIGS. 3 and 4 positioned within the dovetail slot depicted in FIG. 1, where the apparatus is in an inactivated state.
Figure 6:
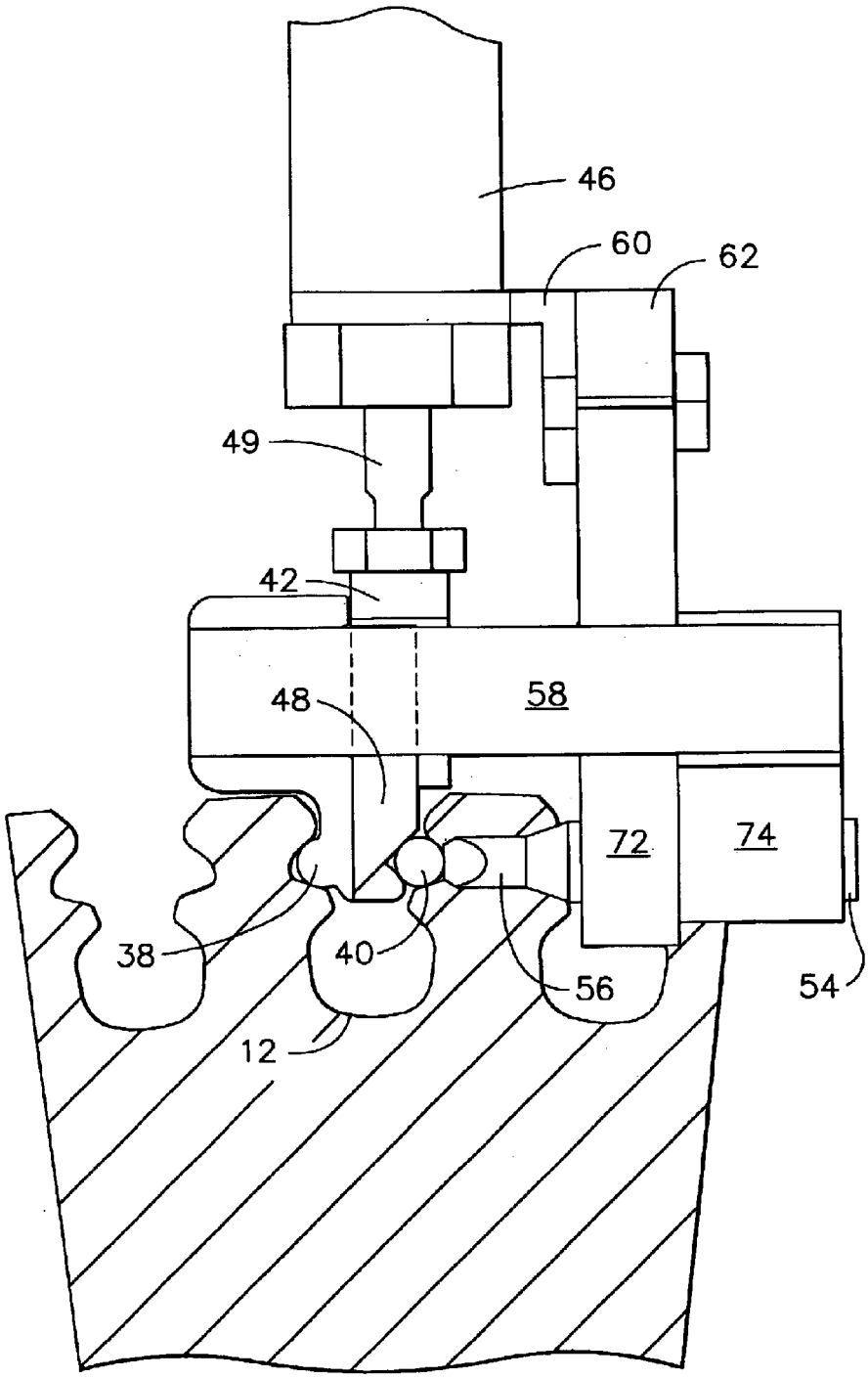
FIG. 6 is a partial side view of the apparatus depicted in FIGS. 3 and 4 positioned within the dovetail slot depicted in FIG. 1, where the apparatus is in an activated state.
Figure 10:
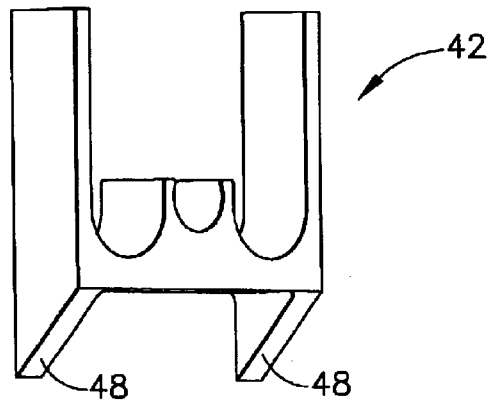
FIG. 10 is a front perspective view of the actuable member depicted in FIGS. 3–7.

It will be seen from FIGS. 3 and 4 that gage 34 includes a first pin member 38 which is fixed in a stationary position and functions as a reference. A second pin member 40 is oriented substantially parallel to first pin member 38 and has the ability to move between a first (inactive) position and a second (active) position as shown in FIGS. 5 and 6. A member 42 is also actuable between a first position and a second position (see FIG. 10). Actuable member 42 functions to automatically position first and second pin members 38 and 40 in a predetermined position within dovetail slot 12 when in the second member position. More specifically, first and second pin members 38 and 40 are preferably automatically seated in slot portions 14 and 16 of dovetail slot 12. This occurs because a pair of tip portions 48 of actuable member extend between first and second pin members 38 and 40 and drives them apart until in the aforementioned seated position. Tip portions 48 are preferably pivotable so as to better interface with first and second pin members 38 and 40. When actuable member 42 is in the first position, second pin member 40 is permitted to move with respect to first pin member 38. This is desirable since width 30 of entrance 28 to dovetail slot 12 is less than slot width 22 (i.e., the width between slot portions 14 and 16 when gage first and second pin members 38 and 40 are seated therein). In this way, gage 34 is able to be positioned so that pin members 38 and 40 are easily inserted within dovetail slot 12. It will also be noted that a ball portion 51 extending from a bottom surface of main plate member 58 assists in locating gage 34 within dovetail slot 12, as it will rest on a surface of disk 10 adjacent dovetail slot 12 when gage 34 is inserted therein.

It will be seen from FIGS. 3 and 4 that gage 34 further includes a mechanism 44 to actuate member 42 between its first and second position. Mechanism 44 preferably includes a pneumatic cylinder 46, a slide valve 47 which operates pneumatic cylinder 46, a flow control valve 50, and a fitting 52 to which an air supply 36 (see FIG. 1) is connected. When pneumatic cylinder 46 is activated by slide valve 47, a shaft 49 associated therewith causes actuable member 42 to slide from its first position to a second position between first and second pin members 38 and 40 as described hereinabove.

Gage 34 also includes at least a first probe 54 for measuring the distance between first and second pin members 38 and 40 when in the predetermined dovetail slot position (e.g., within slot portions 14 and 16). It is preferred that first probe 54 have a retractable blade tip 56 which is positioned against second pin member 40, such as one having identification number DP/1/S made by Solartron Metrology of Northbrook, Ill. First probe 54 then is able to determine the distance between first and second pin members 38 and 40 based on the amount blade tip 56 is retracted when second pin member 40 is locked in its second position. Of course, other types of probes and mounting arrangements may alternatively be utilized.

At least a first or main plate member 58 is utilized with gage 34 to provide a base to which first pin member 38, second pin member 40 actuable member 42 and first probe 54 are assembled in a predetermined manner. More particularly, it will be seen that a bracket 60 is preferably connected to main plate member 58 so that pneumatic cylinder 46 and actuable member 42 are positioned in a desirable orientation with respect to first and second pin members 38 and 40. A clamp plate 62 is also preferably provided so that first pin member 38 and cylinder bracket 50 are connected to main plate member 58. It will be seen in FIG. 3 that a pair of bolts 64 and 66 hold first pin member 38 in position while another pair of bolts 68 and 70 connect clamp plate 62 and cylinder bracket 50. Clamp plate 62 further preferably has a portion 72 in which first probe 54 is preferably positioned with respect to second pin member 40. A guard 74 is also preferably located about first probe 54 for protection.

It will be appreciated that main plate member 58, cylinder bracket 60, and clamp plate 62 are sized in order to provide a desired distance range between first and second pin members 38 and 40 (i.e., between the first and second positions of second pin member 40) which conforms to a given dovetail slot 12. In this regard, one or more spacer plates may be utilized therewith. Moreover, the assembly of main plate member 58, cylinder bracket 60, clamp plate 62 and first pin member 38 is merely exemplary and any other configuration which permits first pin member 38, second pin member 40, actuable member 42 and first probe 54 to function in the manner intended and described herein may be utilized.

Figure 7:
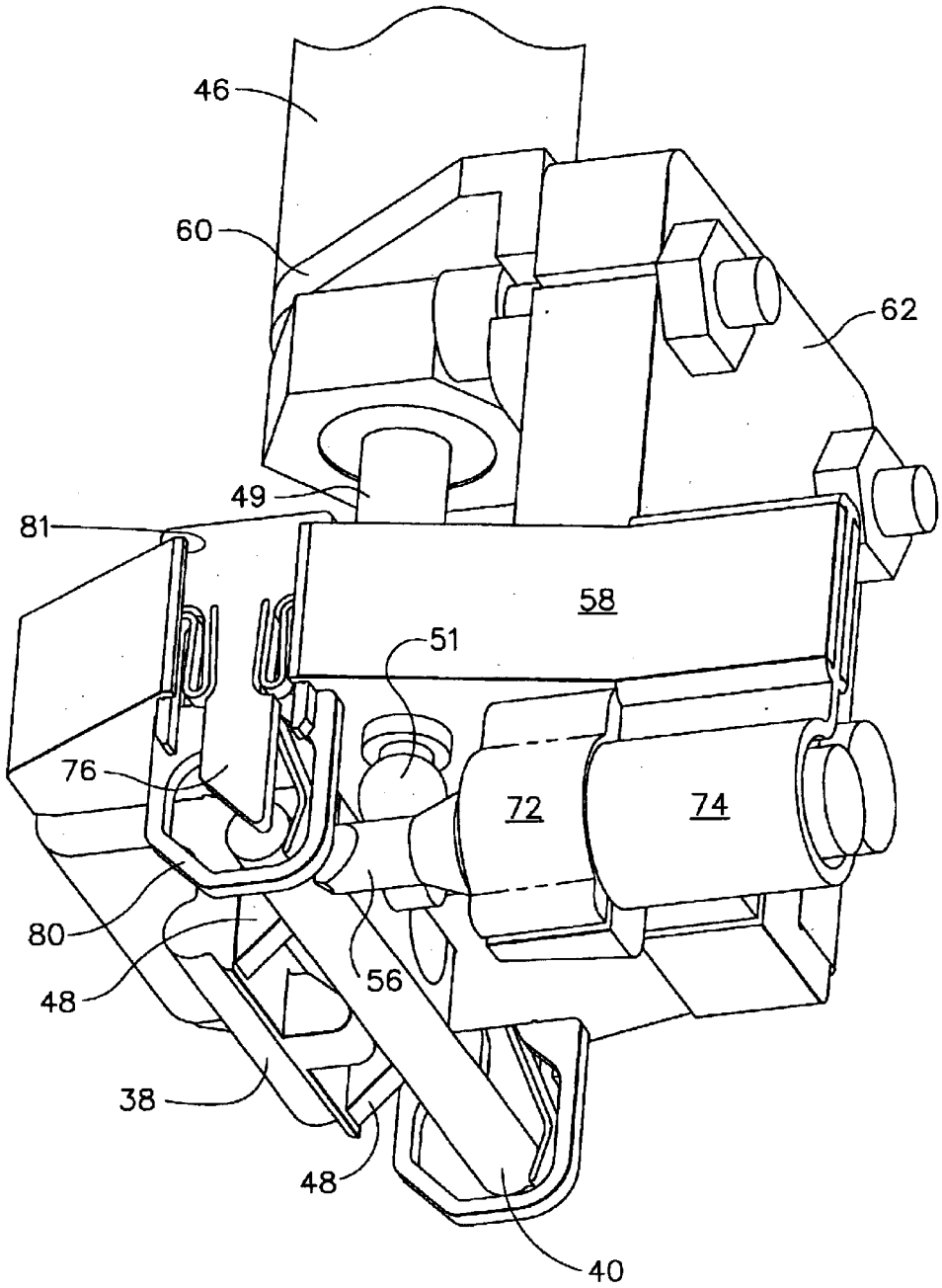
FIG. 7 is an enlarged, partial perspective view of the apparatus depicted in FIGS. 3 and 4.
Figure 8:
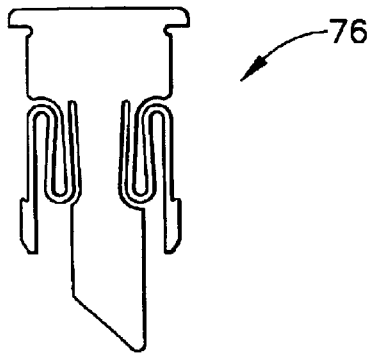
FIG. 8 is a side view of the retention clip depicted in FIGS. 3, 4 and 7.
Figure 9:
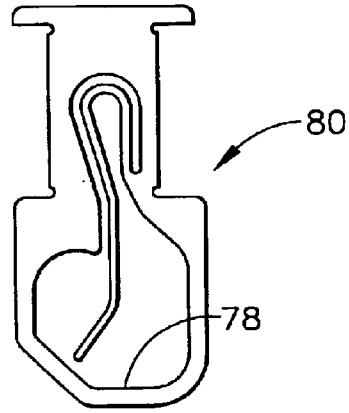
FIG. 9 is a side view of the return spring depicted in FIGS. 3, 4 and 7.

A retention clip 76 is preferably utilized in conjunction with each end of second pin member 40, where second pin member 40 preferably is able to move between a first and second position within an opening 78 formed in a pair of return springs 80 positioned adjacent to retention clips 76 (see FIGS. 3, 4, and 7). FIGS. 8 and 9, respectively, depict retention clip 76 and return spring 80 individually so as to better appreciate the design thereof. For their part, retention clips 76 are fitted within a pair of slots 81 provided on opposite sides of main plate member 58 and prevent second pin member 40 from moving axially out of opening 78 in spring member 80. Once the measurement of slot width 22 has taken place (and actuable member 42 is in its inactive position), return spring 80 preferably engages second pin member 42 in such manner as to assist in removing or disengaging second pin member 40 from slot portion 16 of dovetail slot 12.

A device 82 is preferably connected to first probe 54 in order to receive a signal therefrom representative of the measurement for slot width 22 (see FIG. 1). Device 82 includes a display portion 84 and has the necessary electronics to transform the signal received from first probe 54 into a digital readout of the slot width measurement. An example for device 82 is model DR600 made by Solartron Metrology of Northbrook, Ill. Device 82 may be calibrated so that the digital readout reflects either an actual measurement of slot width 22 or an error amount (positive or negative) from a reference slot width for dovetail 12.

Figure 11:
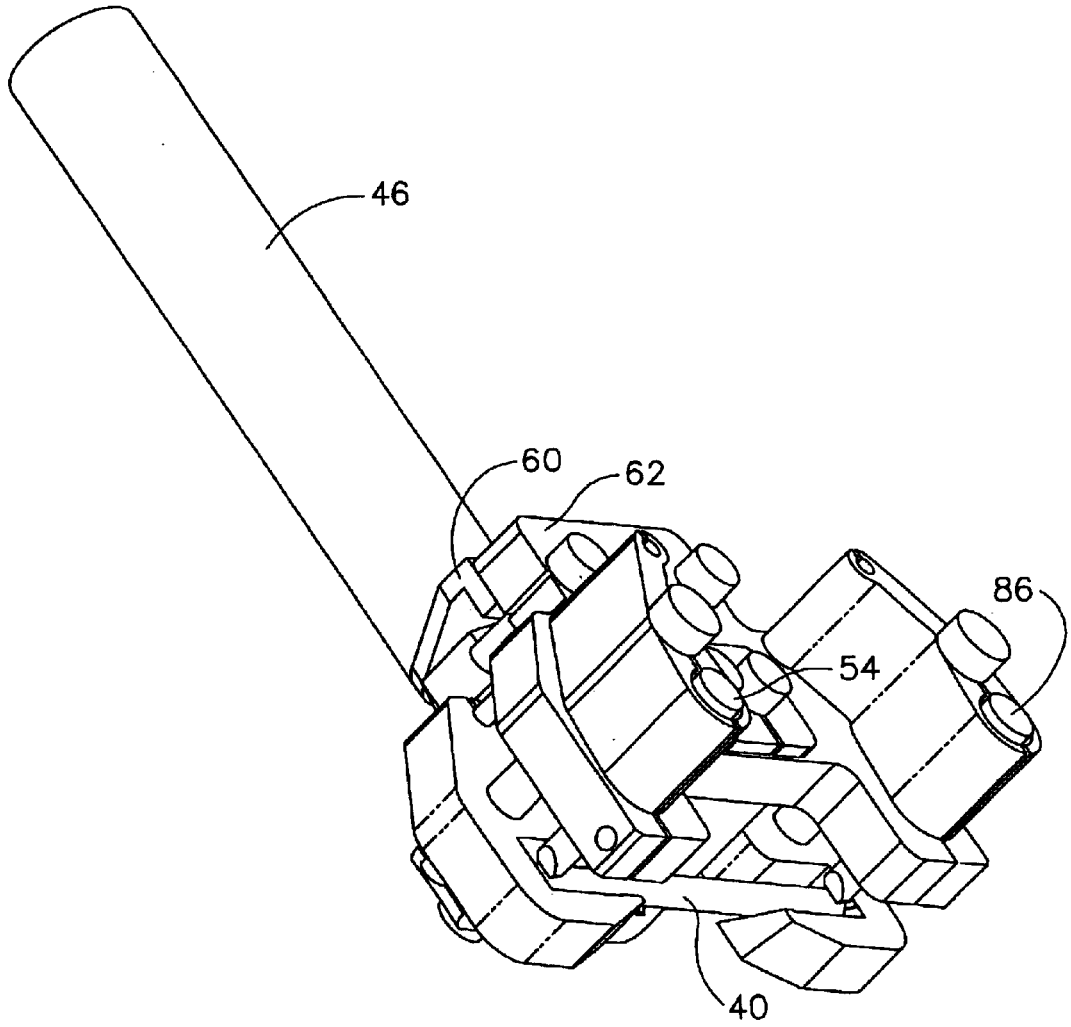
FIG. 11 is a first alternative embodiment of the apparatus depicted in FIGS. 3 and 4, where a spacer plate has been omitted for clarity; and, FIG. 12 is a partial side view of a dovetail for a blade having an apparatus similar to that depicted in FIGS. 3 and 4 positioned thereon in an activated state.

It will be noted from FIG. 11 that gage 34 may also include a second probe 86 mounted to clamp plate 62 opposite to and in spaced relation with first probe 54. In this way, a measurement may be taken with regard to the degree of parallelism of slot portions 14 and 16 via the relationship of first and second pin members 38 and 40 when in the seated position. In this way, the orientation of such slot portions 14 and 16 can be inspected.

Figure 12:
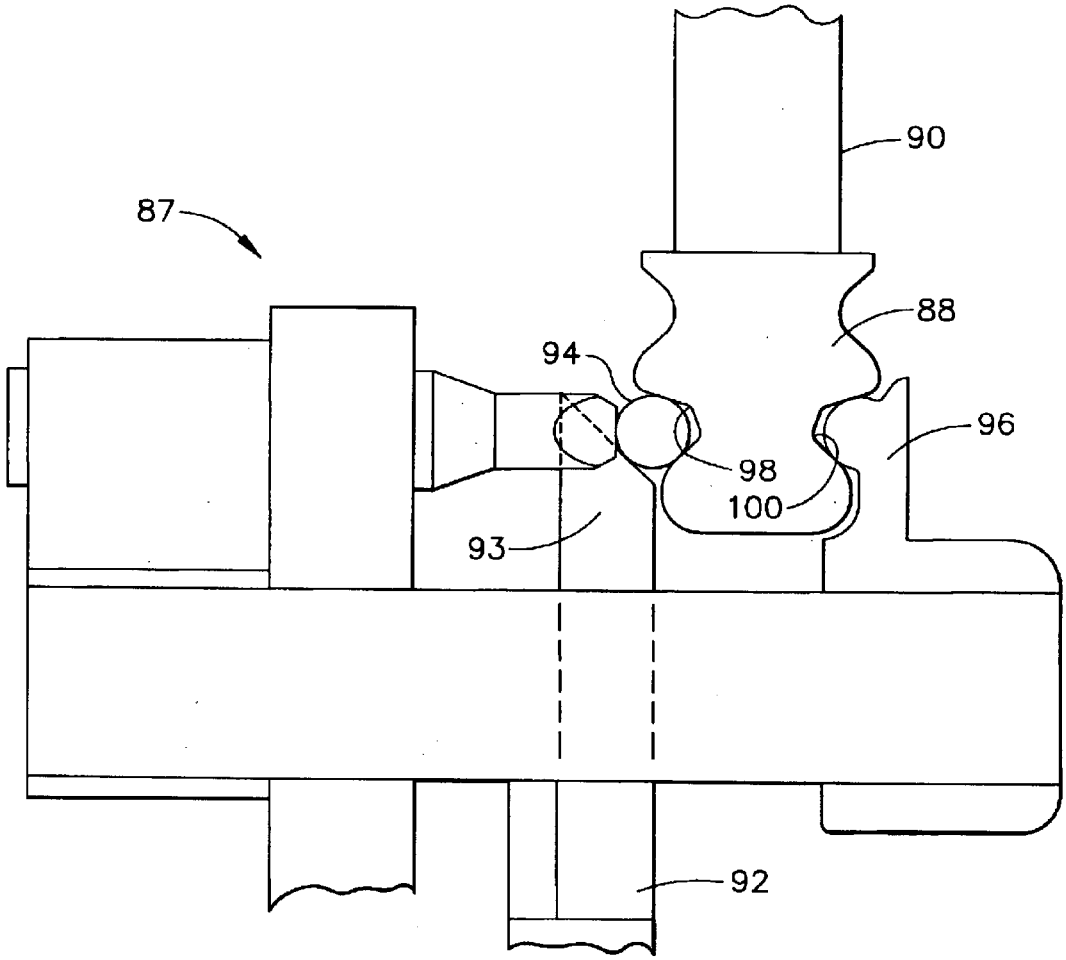

A gage 87 having yet another alternative embodiment is depicted in FIG. 12, where such gage 87 is constructed so as to measure the width of a dovetail 88 for a blade 90. It will be appreciated therefrom that tip portions 93 of an actuable member 92 will be located outside a second pin member 94 instead of between the pin members as described herein for gage 34. In this way, a first pin member 96 and second pin member 94 are brought into contact with opposite portions 98 and 100 of dovetail 88 when actuable member 94 moves from a first position to a second position. The measurement taken between first and second pin members 96 and 94 then serves to monitor the production of dovetail 88 within tight tolerances in the same manner as for dovetail slots 12. Otherwise, alternative gage 87 is constructed in a manner similar to that for gage 34.

In accordance with gage 34 described herein, it will be understood that a dovetail slot 12 for a gas turbine engine disk 10 is inspected by positioning first and second pin members 38 and 40 within dovetail slot 12 (see FIG. 5). Since second pin member 40 is movable between first and second positions, gage 34 is easily inserted into dovetail slot 12 through entrance 28 thereof. Actuable member 42 is then caused to move from a first (inactive) position to a second (active) position so as to interface with second pin member 40 until first and second pin members 38 and 40 are automatically seated in a pair of slot portions 14 and 16, respectively, within dovetail slot 12 (see FIG. 6). Once pin members 38 and 40 are in position, the distance therebetween is measured. After measurement of slot width 22, actuable member 42 is moved or retracted from the second (active) position to the first (inactive) position (see FIG. 5). This may be accomplished simply by deactivating pneumatic cylinder 46 via slide valve 47. Gage 34 (as well as first and second pin members 38 and 40) is then able to be removed from dovetail slot 12 so that measurement of adjacent slots may be taken as needed. In removing gage 34, it is preferred that return spring 80 assist in disengaging second pin member 40 from its seated position within slot portion 16.

It will be recognized that the measuring step above further may include the steps of sensing a position of second pin member 40 with respect to first pin member 38, forming a signal representative of the position for second pin member 40, and providing the signal to a display device 82. In this way, the distance measured between first and second pin members 38 and 40 is displayed in a portion 84 of device 82. A reference distance for slot width 22 may also be established, whereby the measured distance between first and second pin members 38 and 40 can be compared thereto. Accordingly, device 82 is also able to display any difference between the measured distance by first probe 54 and the reference distance. Regardless of which is displayed by device 82, it is preferred that device 82 be calibrated from time to time and certainly with respect to changes in size or configuration for dovetail slots of different disks.

In order to monitor the wear of a broaching device forming dovetail slots 12, it is preferred that the method further include the steps of recording the distance measured for each slot width 22 on a disk 10, comparing the slot width measured for a plurality of dovetail slots 12 to the reference distance, and analyzing the measured distance for such dovetail slots 12 to determine if any trends or discrepancies above a predetermined limit are obtained.

Having shown and described the preferred embodiment of the present invention, further adaptations of gages 34 and 87, as well as the method employed thereby, can be accomplished by appropriate modifications by one of ordinary skill in the art without departing from the scope of the invention.

What is claimed is:

1. An apparatus for inspecting a dovetail slot of a gas turbine engine disk, comprising:

(a) a first pin member fixed in a stationary position;

(b) a second pin member having the ability to move between a first position and a second position, wherein said second pin member is oriented substantially parallel to said first pin member;

(c) a member actuable between a first position and a second position, wherein said member functions to automatically position said first and second pin members in a predetermined position within said dovetail slot when in said second member position;

(d) a first probe for measuring a distance between said first and second pin members when in said predetermined dovetail slot position; and, (e) at least one plate member forming a base to which said first pin member, said second pin member, said actuable member, and said first probe are assembled in a predetermined manner.

2. The apparatus of claim 1, further comprising a mechanism for actuating said member between said first and second member positions.

3. The apparatus of claim 2, said actuating mechanism further comprising:

(a) a pneumatic cylinder having a shaft incorporated therewith;

(b) an air supply connected to said pneumatic cylinder by means of a fitting; and, (c) a slide valve for activating and deactivating said pneumatic cylinder.

4. The apparatus of claim 1, further comprising a device for receiving a signal from said first probe indicative of said measured distance and displaying a result representative thereof.

5. The apparatus of claim 1, said actuable member further comprising at least one tip portion which extends between said first and second pin members in said second member position.

6. The apparatus of claim 5, wherein said tip portion of said actuable member is pivotable.

7. The apparatus of claim 1, wherein said first probe interfaces with said second pin member.

8. The apparatus of claim 1, wherein said first position of said second pin member is located so as to permit insertion of said first and second pin members into an entrance of said dovetail slot.

9. The apparatus of claim 1, wherein said plate members are sized in order to provide a desired distance range between said first and second pin members which conforms to a given dovetail slot.

10. The apparatus of claim 1, further comprising a spring member located adjacent said second pin member for disengaging said second pin member from said second position.

11. The apparatus of claim 1, further comprising a clamp plate connected to said plate member for retaining said probe in position with respect to said second pin member.

12. The apparatus of claim 1, further comprising a second probe aligned with said first pin member, wherein a parallelism measurement of said opposing slots for said dovetail slot is taken between said first and second probes.

13. A method of inspecting a dovetail slot for a gas turbine engine disk, comprising the following steps:

(a) positioning a stationary pin member and a movable pin member within said dovetail slot;

(b) actuating a member from a first position to a second position so as to interface with said movable pin member until said stationary and movable pin members are automatically seated in a pair of substantially parallel slots within said dovetail slot;

(c) measuring a distance between said fixed and movable pin members when in said seated position.

14. The method of claim 13, further comprising the following steps:

(a) establishing a reference distance for said dovetail slot; and, (b) comparing said measured distance between said pin members to said reference distance.

15. The method of claim 13, further comprising the step of retracting said member from said second position to said first position.

16. The method of claim 15, further comprising the step of removing said stationary and movable pin members from said dovetail slot.

17. The method of claim 13, said measuring step further comprising:

(a) sensing a position of said movable pin member with respect to said stationary pin member;

(b) forming a signal representative of said position for said movable pin member;

(c) providing said signal to a display device; and, (d) displaying said distance between said stationary and movable pin members.

18. The method of claim 17, further comprising the step of recording said distance for said dovetail slot.

19. The method of claim 18, further comprising the step of comparing said distance for a plurality of said dovetail slots to said reference distance.

20. The method of claim 19, further comprising the step of analyzing the measured distance for a plurality of said dovetail slots.

21. The method of claim 16, further comprising the step of assisting said movable pin member from said seated position.

22. The method of claim 17, further comprising the step of calibrating said display device.

23. The method of claim 17, further comprising the step of displaying any difference between said measured distance and said reference distance.

24. The method of claim 13, further comprising the step of determining a degree of parallelism between said stationary and movable pin members in said seated position.

25. An apparatus for inspecting a dovetail of a gas turbine engine blade, comprising:

(a) a first pin member fixed in a stationary position;

(b) a second pin member having the ability to move between a first position and a second position, wherein said second pin member is oriented substantially parallel to said first pin member;

(c) a member actuable between a first position and a second position, wherein said member functions to automatically position said first and second pin members in a predetermined position on opposing sides of said dovetail during said second member position;

(d) a first probe for measuring a distance between said first and second pin members when in said predetermined position; and, (e) at least one plate member forming a base to which said first pin member, said second pin member, said actuable member, and said first probe are assembled in a predetermined manner.

26. The apparatus of claim 25, further comprising a mechanism for actuating said member between said first and second member positions.

* * * * *